US010689191B1

(12) United States Patent
Gladbach

(10) Patent No.: US 10,689,191 B1
(45) Date of Patent: Jun. 23, 2020

(54) DUST TRAPPING LID WITH A CONTAINER FOR COLLECTING DIRT FROM VACUUM CANISTERS AND OTHER REFUSE COLLECTING RECEPTACLES

(71) Applicant: Diana Gladbach, Bloomingdale, IL (US)

(72) Inventor: Diana Gladbach, Bloomingdale, IL (US)

( * ) Notice: Subject to any disclaimer, the term of this patent is extended or adjusted under 35 U.S.C. 154(b) by 13 days.

(21) Appl. No.: 16/139,026

(22) Filed: Sep. 22, 2018

Related U.S. Application Data

(60) Provisional application No. 62/562,153, filed on Sep. 22, 2017.

(51) Int. Cl.
*B65F 1/02* (2006.01)
*B65F 1/16* (2006.01)

(52) U.S. Cl.
CPC ..... *B65F 1/1646* (2013.01); *B65F 1/02* (2013.01); *B65F 2001/1676* (2013.01); *B65F 2210/148* (2013.01); *B65F 2230/116* (2013.01); *B65F 2250/114* (2013.01)

(58) Field of Classification Search
USPC ..... 220/254.1, 254.2, 319, 324, 326, 784; 215/350, 351
See application file for complete search history.

(56) References Cited

U.S. PATENT DOCUMENTS 4,331,249 A * 5/1982 Banich, Sr. ..... B65D 41/0442 215/343
6,656,514 B1 * 12/2003 Tubbs ..... A47J 47/08 220/229
6,843,387 B2 * 1/2005 Karaki ..... B65D 81/266 220/229
8,302,798 B2 * 11/2012 Moss ..... B65D 43/0212 220/229
2007/0240579 A1 * 10/2007 Boake ..... B65D 15/16 99/277.1
2012/0248116 A1 * 10/2012 Smyers ..... B65D 45/20 220/324
2013/0233854 A1 * 9/2013 Smyers ..... B65D 53/00 220/240
2016/0101685 A1 * 4/2016 Darpino ..... B60K 15/0406 220/254.2
2018/0177364 A1 * 6/2018 Conrad ..... A47L 9/1683

FOREIGN PATENT DOCUMENTS

EP 0339729 A1 * 11/1989 ..... B65F 1/1607

* cited by examiner

*Primary Examiner* — Fenn C Mathew
*Assistant Examiner* — Alexander Zephir
(74) *Attorney, Agent, or Firm* — Steven Ivy P.C.

(57) ABSTRACT

Disclosed is an apparatus for trapping of dirt and dust, being emptied from a vacuum canister or a refuse canister, into a trash container. The apparatus comprises of: (1) a container, for collecting the dirt and dust, having a closed bottom and an open top, designed to provide access to the internal chamber of the container; (2) flexible membranes, for preventing the entrapped dust from exiting the container; (3) a lid for holding the membranes in position to cover the open top of the container; (4) a living hinge system, for locking the lid to the container; (5) a mortise and tenon joint system, for releasably attaching the membranes to the lid.

4 Claims, 9 Drawing Sheets

DUST TRAPPING LID WITH A CONTAINER FOR COLLECTING DIRT FROM VACUUM CANISTERS AND OTHER REFUSE COLLECTING RECEPTACLES

PRIORITY APPLICATION

The present Non-Provisional U.S. Patent Application claims the priority from U.S. Provisional Patent Application No. 62/562,153 filed on Sep. 22, 2017, titled Universal Dust Trapping Lid With a Receptacle for Collecting Dirt from Vacuum Canisters and Other Refuse Collecting Containers, the subject matter of which is incorporated herein by reference.

FIELD OF THE INVENTION

The present invention addresses the general field of containers utilized for collection and disposal of dirt and wide variety of refuse.

BACKGROUND OF THE INVENTION

The present invention is the result of countless, frustrating attempts at holding back the billowing dust, resulting from the process of emptying dirt-containing vacuum canisters, into the typical garbage container. Although the origins of this invention are directly related to common vacuum systems, it is likely that the same invention, possibly implementing improvements foreseeable by a person of ordinary skill in the art, may be utilized with other refuse collecting containers.

SUMMARY OF THE INVENTION

The following is intended to be a brief summary of the invention and is not intended to limit the scope of the invention:

The disclosed herein invention represents a receptacle assembly for collecting of dirt and dust from vacuum canisters and other refuse gathering containers. The assembly comprises of five components: (1) container, for collecting the dirt and dust, having a closed bottom and an open top, providing access to the internal chamber of the container; (2) the flexible membranes (the top and the bottom), for preventing the entrapped dirt/dust from exiting said container; (3) the lid for holding the said membranes in position to cover the open top of the container; (4) the living hinge system, for releasably locking the lid to the open top of the container; (5) the mortise and tenon joint system, for releasably attaching said membranes to the lid. Wherein said assembly permits the end-user to insert a vacuum canister into the container, through the membranes held by the lid, and dispose inside the container the dirt/dust of said canister, while preventing the entrapped dust from exiting the internal chamber of the container.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

100—container with refuse and dust trapping lid (assembly)
- 110—container
  - 111—side walls
    - 112—internal surface of the side wall
    - 113—external surface of the side wall

114—bottom end of the side wall
115—top end of the side wall
116—bottom plate of the container
117—closed bottom of the container
118—open top of the container
119—internal chamber of the container
120—lid
121—top wall
122—internal surface of top wall
123—external surface of top wall
124—side wall
125—internal surface of side wall
126—external surface of side wall
130—living hinge system
131—ridge of the container
132—L-shaped hinges (log part and short part)
140—top membrane
141—center surface of the top membrane
142—perimeter surface of the top membrane
143—pyramid-shaped cutouts of the top membrane
144—center opening of the top membrane
150—bottom membrane
151—center surface of the bottom membrane
152—perimeter surface of the bottom membrane
153—pyramid-shaped cutouts of the bottom membrane
154—center opening of the bottom membrane
160—MORTISE AND TENON JOINT SYSTEM
161—mortises inside the top membrane
162—mortises inside the bottom membrane
163—tenons attached to the lid
200—dirt and dust canister
300—end-user

DETAILED DESCRIPTION OF THE PREFERRED EMBODIMENT OF THE PRESENT INVENTION

Figure 1:
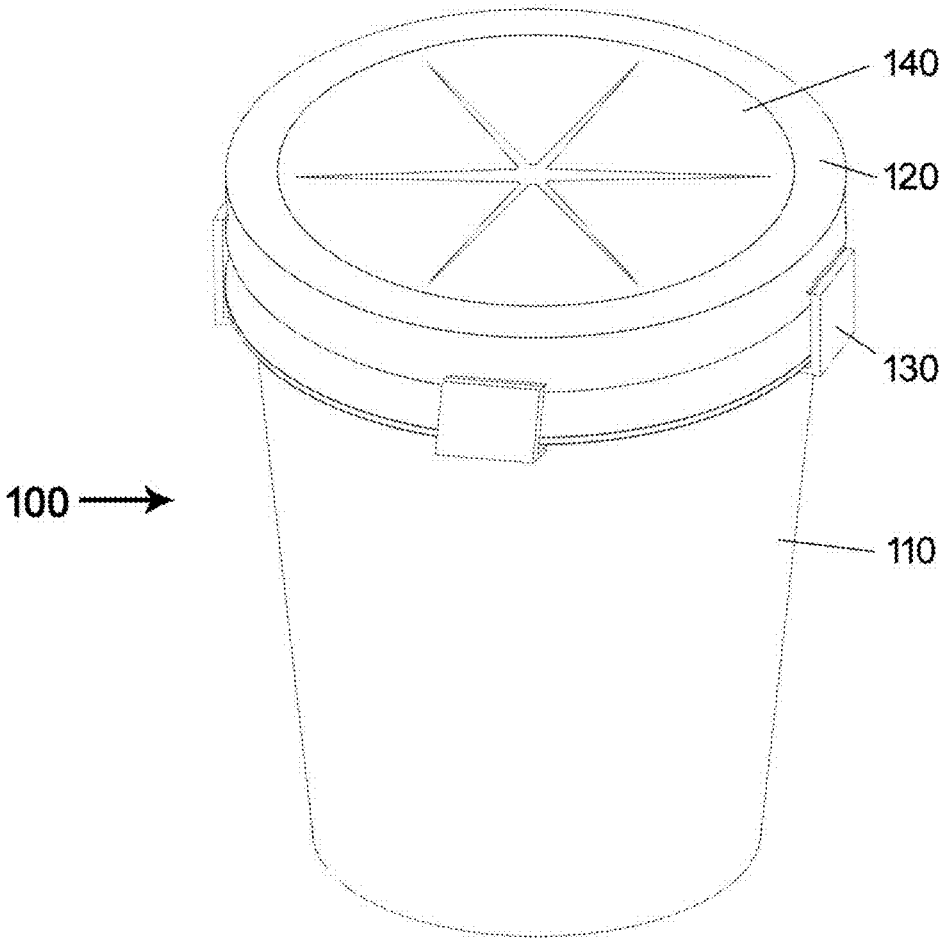
FIG. 1 is a perspective view of the present invention, the container with refuse and dust trapping lid, fully assembled, with the lid component having a single membrane (the top membrane) attached thereto, in accordance with an exemplary embodiment of the present invention.
Figure 2:
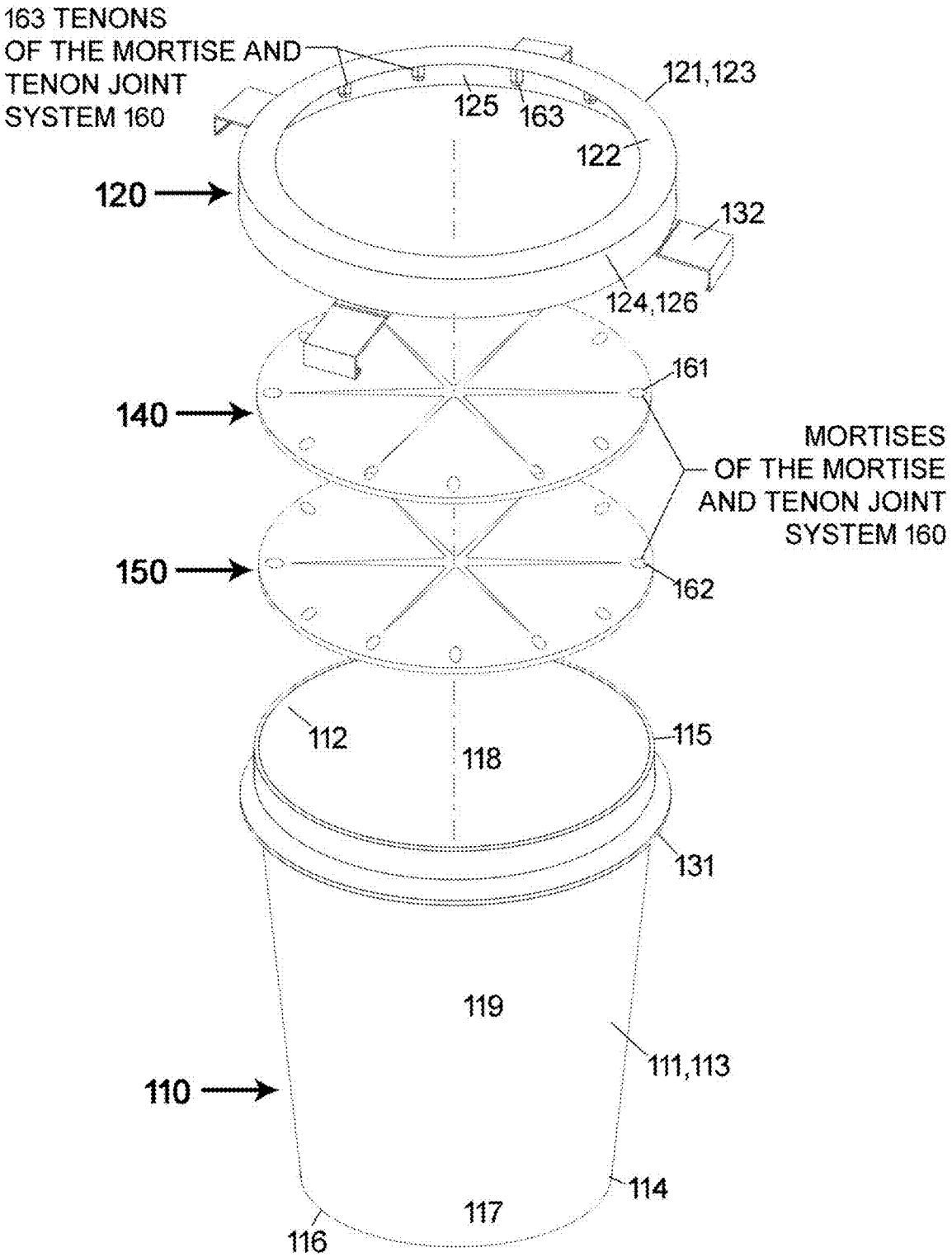
FIG. 2 is an exploded view of the assembly of the present invention, showing the components forming said assembly, including the container (with the ridge of the living hinge system attached thereto), the top and the bottom membranes (each of said membranes incorporating the tenons numerous mortises of the mortise and tenon joint system), the lid (incorporating the L-shaped hinges of the living hinge system), in accordance with an exemplary embodiment of the present invention.
Figure 3:
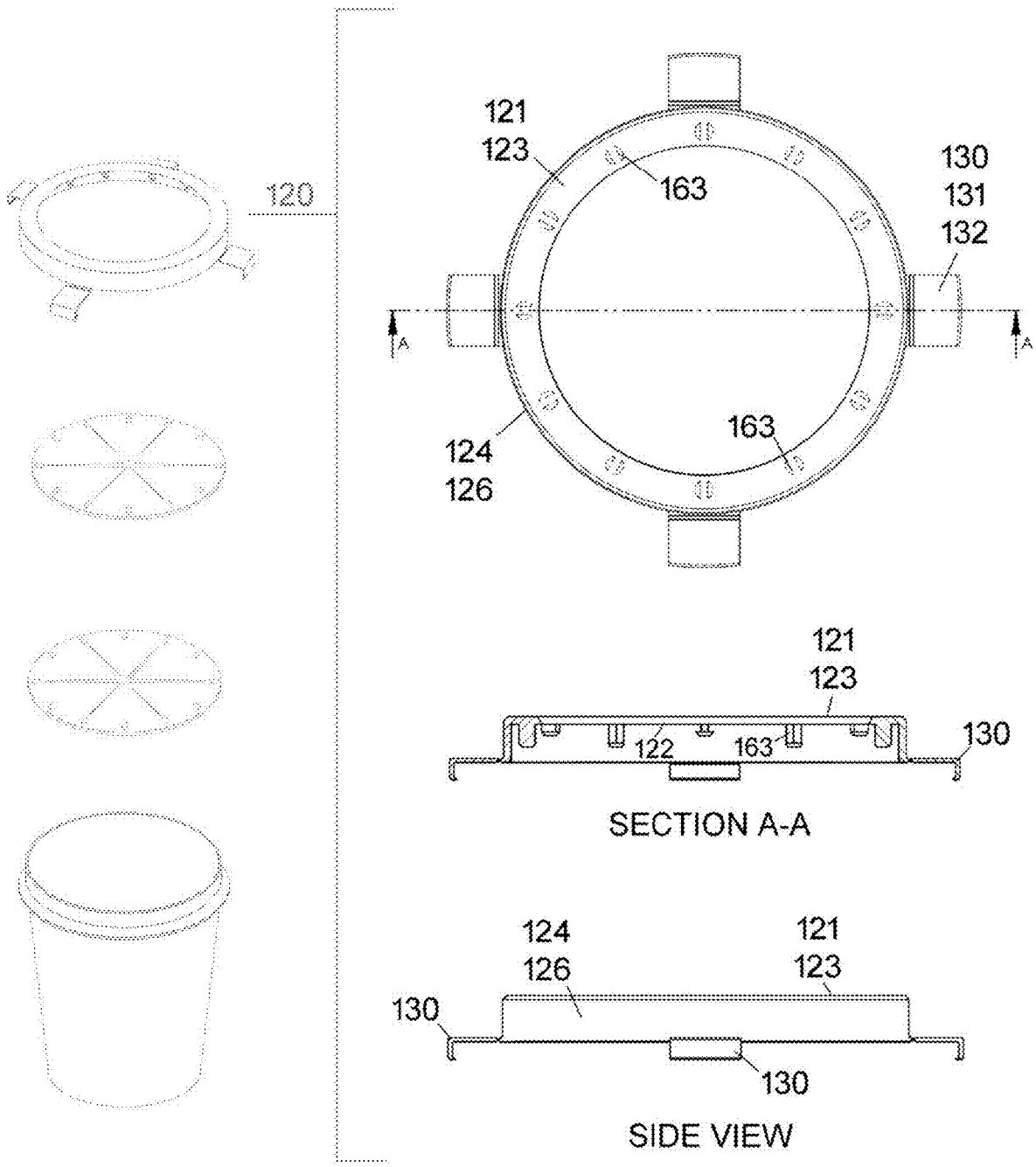
FIG. 3 is a top view of the lid component, incorporating the living hinge system's L-shaped hinges, showing with broken lines the positioning of the tenons (flex pins), of the mortise and tenon joint system, attached to the internal surface of the top wall of the lid; including are also the sectional and the side view of the lid component, in accordance with an exemplary embodiment of the present invention.
Figure 4:
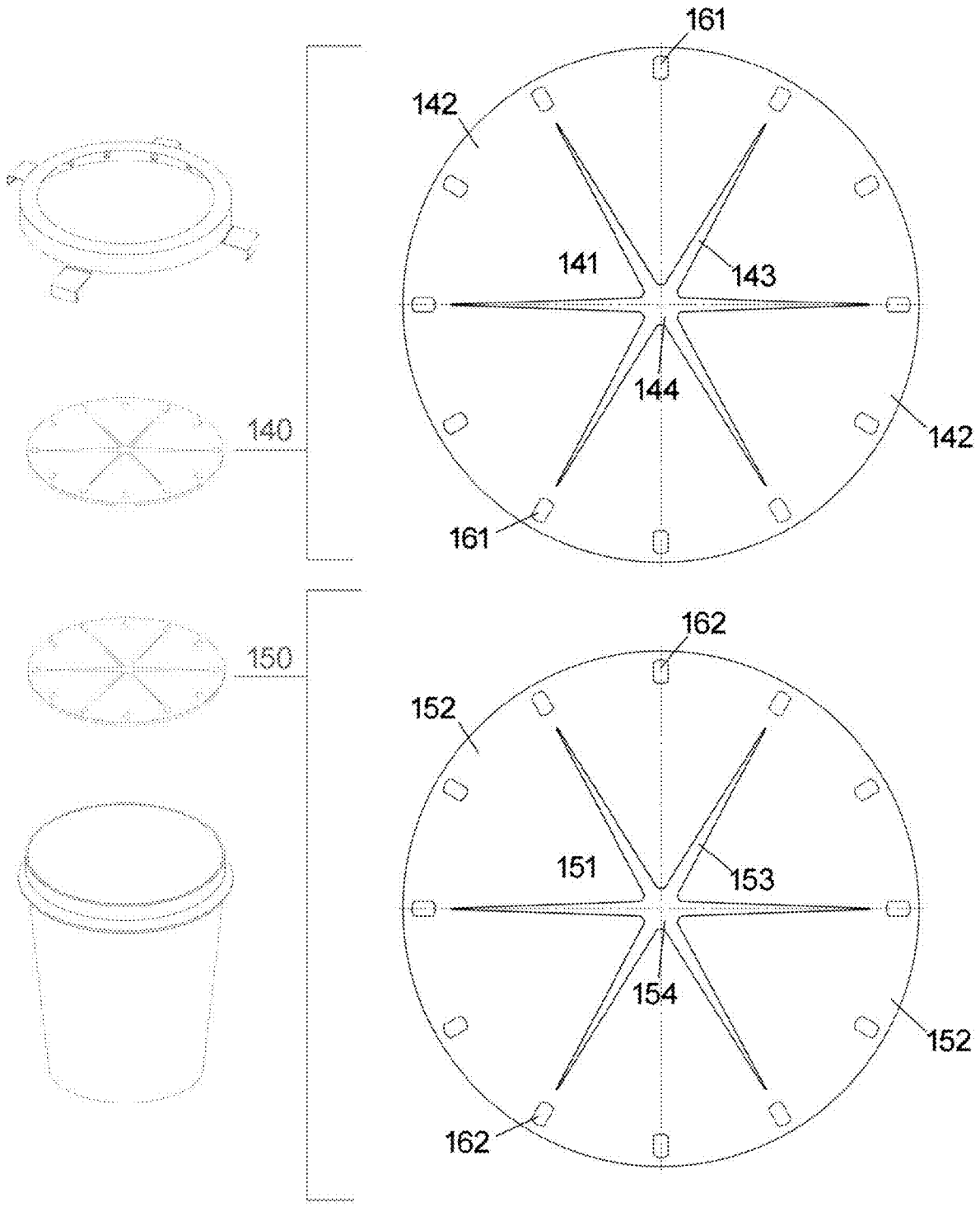
FIG. 4 is top view of both the top membrane and the bottom membrane, with both membranes incorporating the pyramid-shaped cutouts and the mortises of the mortise and tenon joint system, positioned along the perimeter of said membranes, in accordance with an exemplary embodiment of the present invention.
Figure 5:
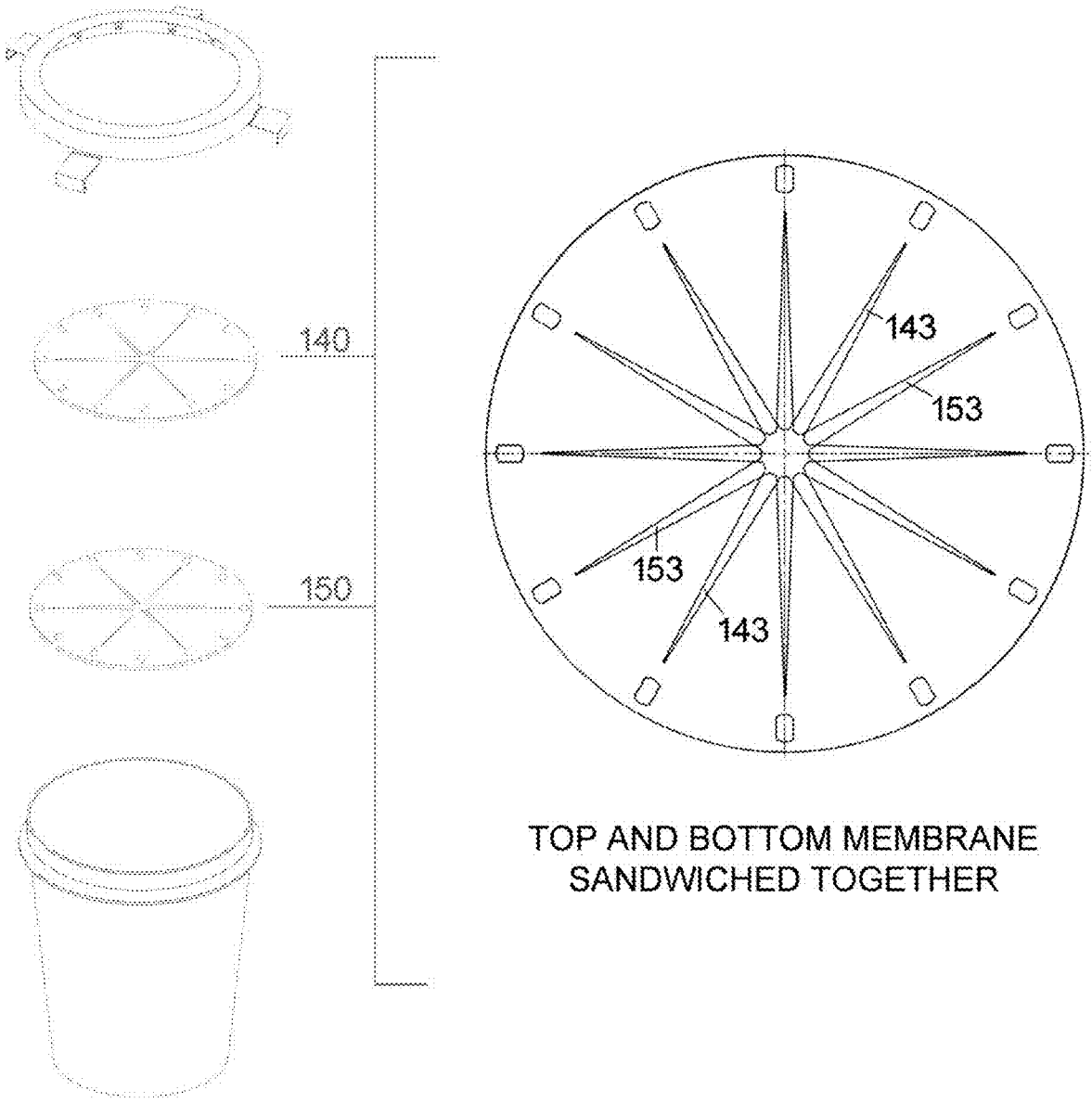
FIG. 5 is a top view of the top membrane and the bottom membrane sandwiched together, wherein said bottom membrane has been rotated, allowing for its pyramid-shaped cutouts to be hidden beneath the center surface of the top membrane, thereby forming a continuous shield, designed to trap the dirt and the dust deposited into the container, in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

As shown in FIGS. 1 and 2, the present invention is an assembly forming a receptacle for collecting of dirt and dust from vacuum canisters and other refuse gathering containers 100. The assembly comprises of the following components:

(1) The container 110, shown in FIGS. 1, 2, 8 and 9, designed for collecting the dirt and dust collected by vacuums and other refuse collecting devices. The container 100 comprises of side walls 111 connected to a bottom plate 116, forming a container having a closed bottom 117 with an open top 118, providing access the internal chamber of the container 119;

(2) The membranes, sub-divided into top membrane 140 and the bottom membrane 150, shown in FIGS. 2, 4 and 5, designed for preventing the entrapped dirt/dust from exiting the container 110;

(3) The lid 120, shown in FIGS. 1, 2, 3, 6, 7, 8 and 9, for holding the said membranes 140/150 in position to cover the open top 118 of the container 110;

(4) The living hinge system 130, for releasably locking the lid 120 to the open top 118 of the container 110;

(5) The mortise and tenon joint system 160, for releasably attaching said membranes 140/150 to the lid 120.

To complete the above-defined assembly 100, the end-user 300 must invert the lid 120, and expose the internal surface 122 of the top wall 121, and locate attached thereto a plurality of mortises 163 (flexible plastic pins). Next, the end-user 300 must attach to the lid 120 the top membrane 140.

To do so, the end-user 300 must align the top membrane's mortises (located in the perimeter surface 142 of the membrane 140) with the corresponding tenons of the lid 120. Once aligned, the end-user 300 must push the membrane 140 inside the lid 120, engaging the mortise and tenon joints 160, and thereby completing the membrane 140 to lid 120 attachment process.

Figure 6:
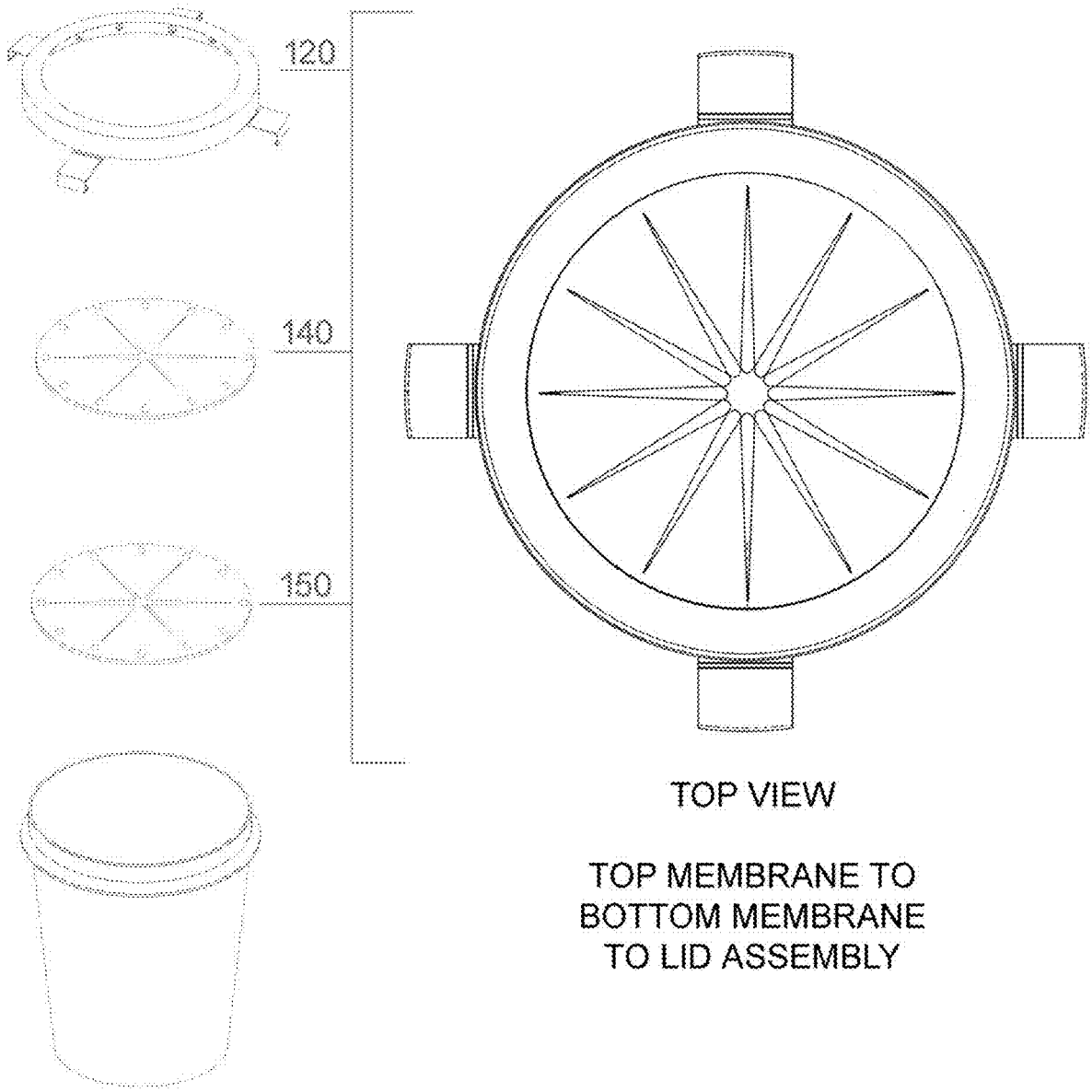
FIG. 6 is a top view of the lid sub-assembly, comprising of the lid, the top membrane and the bottom membrane, incorporating the living hinge system, shown in an open position, in accordance with an exemplary embodiment of the present invention.

To improve the functionality of the assembly 100, the end-user 300 may attach an addition membrane (the bottom membrane 150) to the lid 120, by using the above-defined mortise and tenon joint system 160. Before attaching the bottom membrane 150 to the lid 120, the end-user must rotate the bottom membrane 150 by 90°, thus placing the top membrane's pyramid-shaped cutouts 143 on the center surface 151 of the bottom membrane 150, as shown in FIGS. 5 and 6. This misalignment of membranes, forms a flexible, yet reliable shield, capable of holding back any dirt and dust being deposited into the container 110.

Figure 7:
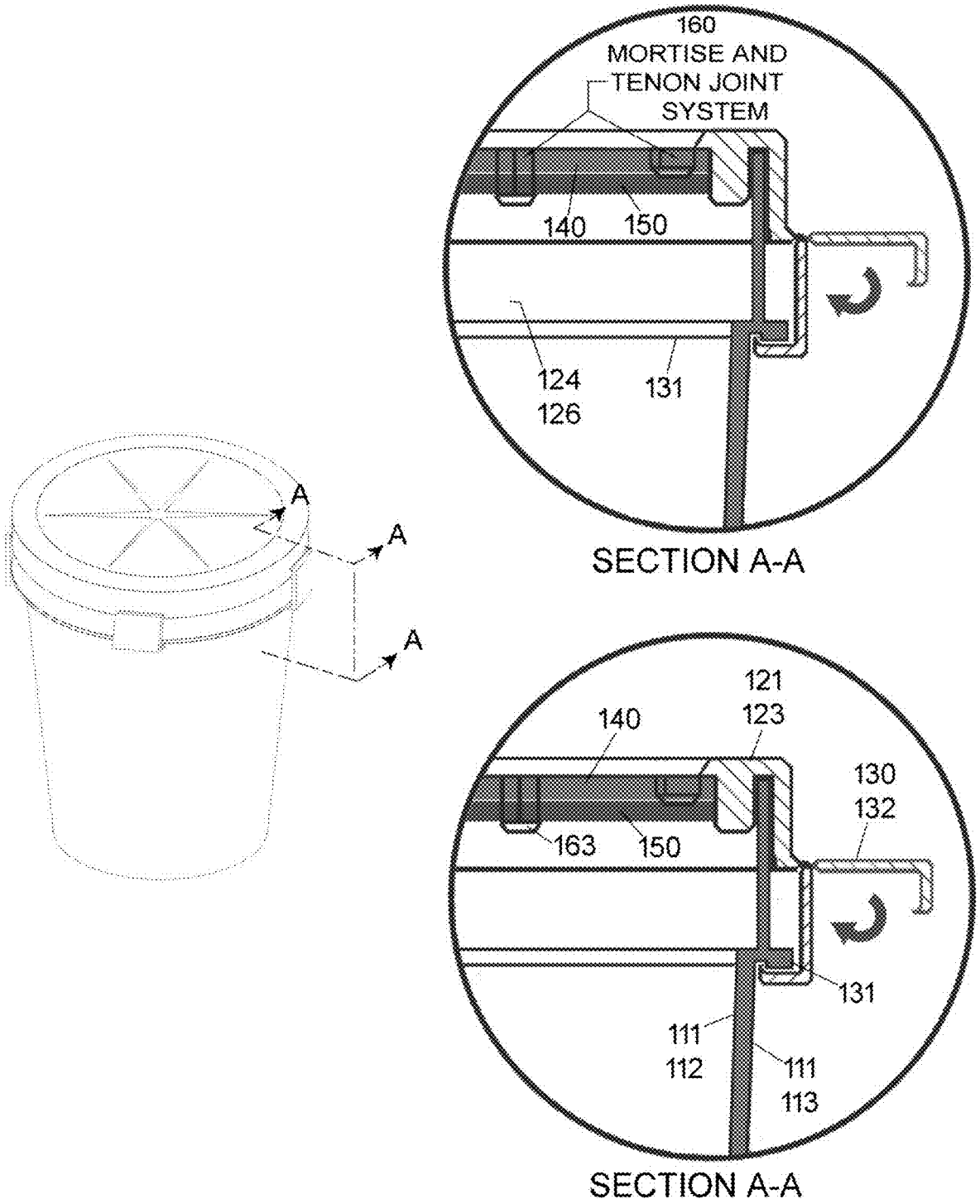
FIG. 7 is a section view of the living hinge sub-assembly, shown in closed position, focusing on the L-shaped hinge connection with the ridge of the living hinge system; said sectional view also shows the positioning inside the lid component of both the top membrane and the bottom membrane; in accordance with an exemplary embodiment of the present invention.

Once the membranes 140/150 are attached to the lid 120, the end-user 300 may use the living hinge system 130 to cover the open top 118, and lock the lid 120 to the container 110. To lock the lid 120 in place, the end-user 300 must place the lid 120 (containing the membranes 140/150) on the open top 118 of the container 110, and push down on the L-shaped hinges 132, until the short sections of said hinges are wedged underneath the ridge of the container 131, as shown in FIG. 7.

Figure 8:
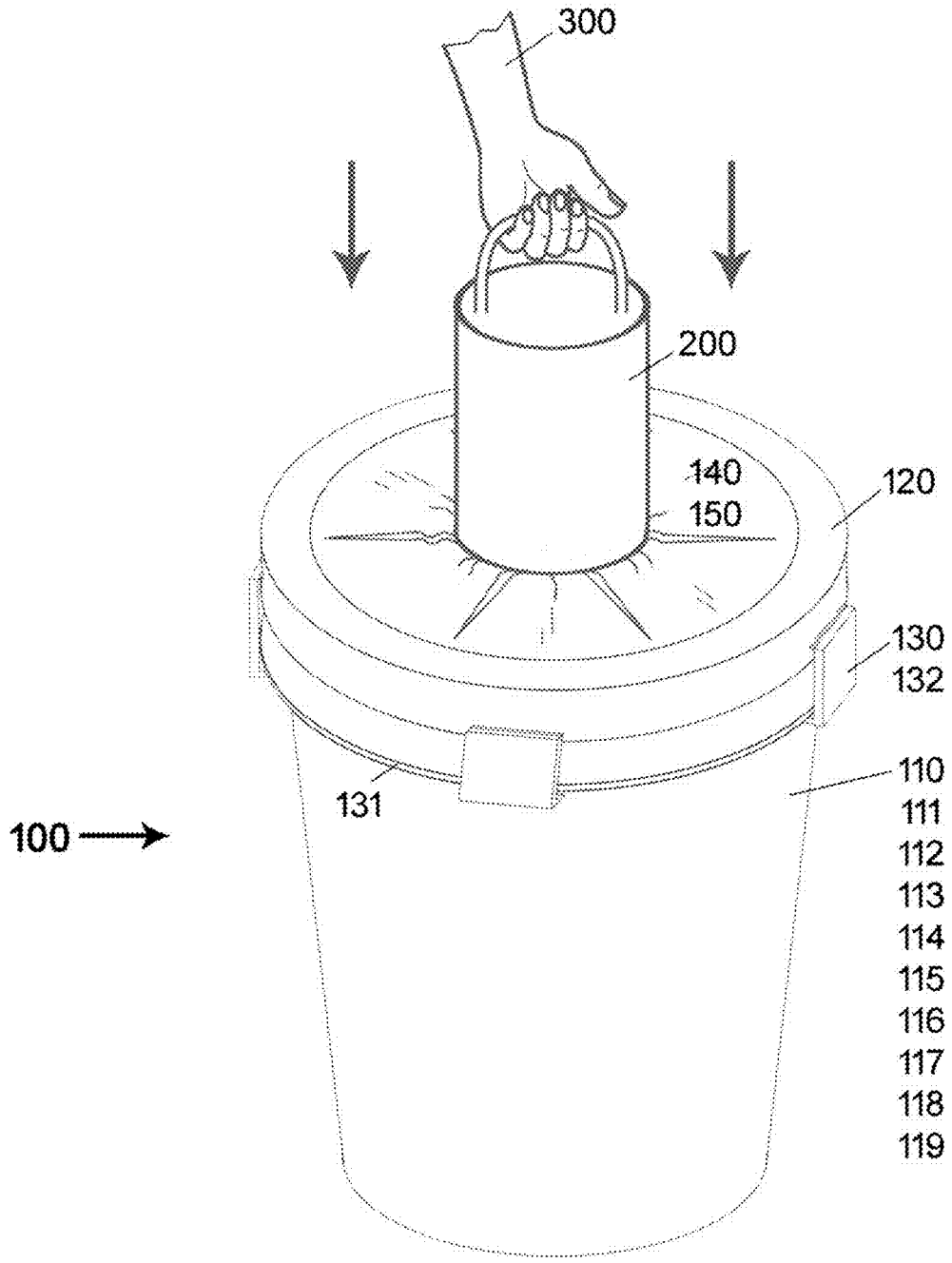
FIG. 8 is perspective view of a fully-assembled container with the dust trapping lid, showing the end-user pushing inside the container a canister, through the center of the membrane, in preparation to deposit inside the container the dirt/dust stored inside the canister, in accordance with an exemplary embodiment of the present invention.
Figure 9:
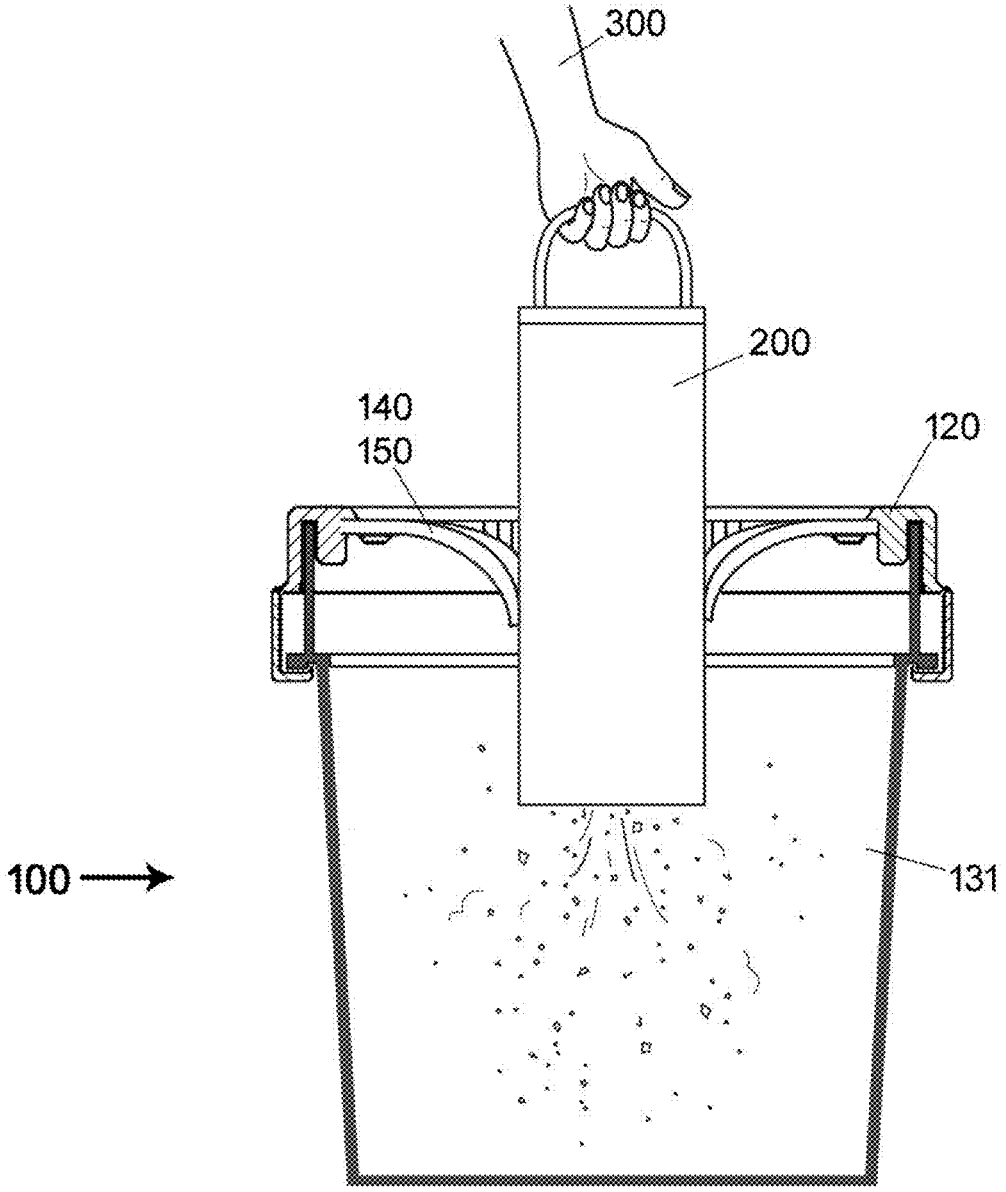
FIG. 9 is sectional view of the fully-assembled container with the dust trapping lid, showing the process of depositing inside the container the dirt/dust contained inside the canister held by the end-user, in accordance with an exemplary embodiment of the present invention.

Once the lid 120 is firmly locked to the top end of the container 110, the end-user 300 may begin the process of emptying into the container 110 the dirt from the vacuum canister 200, or other refuse collecting canisters. To ensure the proper results, the end-user 300 must partially insert the canister 200, through the membranes 140/150 of the lid 120, into the chamber of the container 119, as shown in FIGS. 8 and 9.

Once in position, the end-user 300 may open the canister 200 and release the dirt contained therein, allowing it to fall to the bottom of the container 110. The lighter dirt particles and the accumulating dust, will be trapped inside the chamber 119, between the bottom plate of the container 116 and by the membranes 140/150 tightly enclosing the canister's 200 eternal walls.

What is claimed is:

1. A container with refuse and dust trapping lid, comprising:

A) a container having
  i. a side wall, circular in shape, having an internal surface an external surface a bottom end and a top end
  ii. a bottom plate fixedly-contiguous to the bottom end of the side wall thereby forming the container having a closed bottom an open top and an internal chamber, B) a lid similarly-shaped to the container having
  i. a top wall similarly-shaped having an internal surface and an external surface
  ii. a side wall contiguous and perpendicular to the top wall having an internal surface and an external surface, C) a living hinge system for releasably locking the lid to the open top of the container, D) a top membrane similarly-shaped to the container having
  i. a center surface a perimeter surface ii. a plurality of pyramid-shaped cutouts with their bases connected at the center surface forming a center opening and their peaks pointing toward the membrane's perimeter surface, and E) a mortise and tenon joint system for releasably attaching the top membrane to the internal surface of the top wall of the lid is via a mortise and tenon joint system having i. a plurality of tenons, made of flexible push pins protruding downward fixedly attached to the internal surface of the top wall of the lid, and ii. a plurality of mortises, made of elongated holes, located along the perimeter of the top membrane, each of said mortises in position corresponding to the position of the plurality of the tenons, so that when the top membrane is pushed inside the lid, the mortises connect with the tenons, thereby releasably attaching the top membrane to the internal surface of the top wall of the lid, whereby the bottom membrane is attached to the lid, disposed directly below the top membrane, so that the pyramid-shaped cutouts of the first top membrane are covered by the bottom membrane center surface, forming a flexible, continuous shield designed to part way when the end-user is inserting through its center surface, a canister holding dirt, trapping inside any/all dust being released from said canister into the internal chamber of the container.

2. The container with refuse and dust trapping lid of claim 1 wherein:

said plurality of tenons are made from plastic.

3. The container with refuse and dust trapping lid of claim 1 wherein:

said plurality of tenons are made from material selected from a group consisting of aluminum alloys, metal, wood, fibre board, nylon, rubber.

4. A container with refuse and dust trapping lid, comprising:

A) a container having i. a selected number of side walls wherein each of said side walls has an internal surface an external surface a bottom end and a top end, ii. a bottom plate fixedly-contiguous to the bottom end of the side wall thereby forming a container having a closed bottom an open top and an internal chamber, B) a lid similarly-shaped to the container having i. a top wall similarly-shaped having an internal surface and an external surface, ii. a side wall contiguous and perpendicular to the top wall having an internal surface and an external surface, C) a living hinge system for releasably locking the lid to the open top of the container, said living hinge system comprises of i. a ridge fixedly attached to the container disposed below the top end protruding from the container's side wall, ii. a plurality of L-shaped hinges pivotally attached to the external surface of the side wall of the lid, positioned so that when pushed down toward the external walls of the container the shorter part of the L-shaped hinge can tightly fit underneath the ridge, thereby releasably locking the lid to the open top of the container, D) a top membrane similarly-shaped to the container having i. a center surface a perimeter surface, ii. a plurality of pyramid-shaped cutouts with their bases connected at the center surface forming a center opening and their peaks pointing toward the membrane's perimeter surface, E) a mortise and tenon joint system for releasably attaching said top membrane to the internal surface of the top wall of the lid, said mortise and tenon joint system comprises of i. a plurality of tenons, made of flexible push pins protruding downward fixedly attached to the internal surface of the top wall of the lid, and ii. a plurality of mortises, made of elongated holes, located along the perimeter of the top membrane, each of said mortises in position corresponding to the position of the plurality of the tenons, so that when iii. membrane is pushed inside the lid, the mortises connect with the tenons, thereby releasably attaching the top membrane to the internal surface of the top wall of the lid, whereby said top membrane, attached to the lid releasably locked to the open top of the container, will part way when the end-user is inserting through its center surface, a canister holding dirt, trapping inside any/all dust being released from said canister into the internal chamber of the container.

* * * * *